US009140204B2

(12) United States Patent
Gorenflo et al.

(10) Patent No.: US 9,140,204 B2
(45) Date of Patent: Sep. 22, 2015

(54) HANDHELD WORK APPARATUS HAVING AN AIR-COOLED COMBUSTION ENGINE

(75) Inventors: Ernst Gorenflo, Bad Rappenau (DE); Eberhard Schieber, Backnang (DE); Heinrich Leufen, Schwaikheim (DE); Michael Harrer, Stuttgart (DE); Claus Naegele, Stuttgart (DE); Andreas Neubauer, Ludwigsburg (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 523 days.

(21) Appl. No.: 12/926,194

(22) Filed: Nov. 1, 2010

(65) Prior Publication Data

US 2011/0107985 A1 May 12, 2011

(30) Foreign Application Priority Data

Nov. 6, 2009 (DE) ..... 10 2009 053 236

(51) Int. Cl.

| | |
|---|---|
| ***F02D 35/02*** | (2006.01) |
| ***F02D 41/22*** | (2006.01) |
| ***F02D 41/04*** | (2006.01) |
| ***F02P 5/14*** | (2006.01) |
| *F02D 41/00* | (2006.01) |

(52) U.S. Cl.

CPC ..... *F02D 41/22* (2013.01); *F02D 35/025* (2013.01); *F02D 41/045* (2013.01); *F02P 5/14* (2013.01); *F02D 41/0002* (2013.01); *F02D 2200/021* (2013.01); *F02D 2200/0414* (2013.01); *F02D 2400/06* (2013.01)

(58) Field of Classification Search

CPC . F02D 35/025; F02D 41/045; F02D 41/0002; F02D 2200/021; F02D 2200/0414; F02D 2400/06; F02P 5/14

USPC ..... 123/41.65, 344, 406.55, 41.15, 198 D

See application file for complete search history.

(56) References Cited

U.S. PATENT DOCUMENTS

| | | | | |
|---|---|---|---|---|
| 4,389,994 | A * | 6/1983 | Denz et al. | 123/406.55 |
| 4,805,571 | A * | 2/1989 | Humphrey | 123/316 |
| 4,979,477 | A * | 12/1990 | Nickel et al. | 123/335 |
| 5,769,055 | A * | 6/1998 | Motose et al. | 123/478 |

(Continued)

FOREIGN PATENT DOCUMENTS

| | | |
|---|---|---|
| JP | 63-12870 A | 1/1988 |
| JP | 2-196146 A | 8/1990 |

(Continued)

*Primary Examiner* — Lindsay Low
*Assistant Examiner* — Grant Moubry
(74) *Attorney, Agent, or Firm* — Walter Ottesen P.A.

(57) ABSTRACT

A portable, handheld work apparatus such as a chain saw has a handle (5, 7) to guide the work apparatus (1) and has an air-cooled, mixture-lubricated combustion engine (10) arranged in a casing as a drive for a work tool (3). The cylinder (11) has a combustion chamber (13) formed therein to which an air/fuel mixture is supplied. The air/fuel mixture is ignited by a spark plug (23) which projects into the combustion chamber (13). An ignition control (30) triggers a spark in dependence on the angular position of the crankshaft (15). A temperature sensor (35, 45, 55) is provided to control the cylinder temperature. The temperature signal of the temperature sensor (35, 45, 55) is connected to a power control (40). When a predetermined temperature is exceeded, the power control (40) changes the operating parameters of the combustion engine (10) in such a manner that the power of the combustion engine (10) is changed.

30 Claims, 1 Drawing Sheet

(56) References Cited

U.S. PATENT DOCUMENTS

| | | | | |
|---|---|---|---|---|
| 6,363,315 | B1 * | 3/2002 | Love et al. | 701/104 |
| 6,505,616 | B2 * | 1/2003 | Hehnke | 123/588 |
| 6,529,815 | B2 * | 3/2003 | Hawkins et al. | 701/104 |
| 6,880,525 | B2 * | 4/2005 | Geyer et al. | 123/406.18 |
| 6,976,472 | B2 * | 12/2005 | Nickel | 123/406.25 |
| 7,258,083 | B2 * | 8/2007 | Lindsey | 123/41.08 |
| 7,275,505 | B2 * | 10/2007 | Moeller et al. | 123/46 SC |
| 7,299,963 | B2 * | 11/2007 | Moeller et al. | 228/8 |
| 7,341,171 | B2 * | 3/2008 | Moeller et al. | 227/8 |
| 7,353,804 | B2 * | 4/2008 | Bucktron et al. | 123/436 |
| 7,497,271 | B2 * | 3/2009 | Moeller et al. | 173/1 |
| 7,536,983 | B2 * | 5/2009 | Layher et al. | 123/73 B |
| 7,814,888 | B2 | 10/2010 | Rosskamp et al. | |
| 7,849,831 | B2 * | 12/2010 | Ono | 123/179.24 |
| 8,074,623 | B2 * | 12/2011 | Carlsson et al. | 123/436 |
| 8,386,149 | B2 | 2/2013 | Bellistri et al. | |
| 2006/0260568 | A1 * | 11/2006 | Moeller et al. | 123/46 H |
| 2007/0028881 | A1 * | 2/2007 | Nakata et al. | 123/179.15 |
| 2009/0013951 | A1 * | 1/2009 | Nakata et al. | 123/179.14 |
| 2009/0193669 | A1 * | 8/2009 | Gorenflo | 30/382 |

FOREIGN PATENT DOCUMENTS

| | | | |
|---|---|---|---|
| JP | 4-27150 | U | 3/1992 |
| JP | 4-231628 | A | 8/1992 |
| JP | 7-83090 | A | 3/1995 |
| JP | 8-49639 | A | 2/1996 |
| JP | 9-163877 | A | 6/1997 |
| JP | 9-170434 | A | 6/1997 |
| JP | 9-189671 | A | 7/1997 |
| JP | 2001-200745 | A | 7/2001 |
| JP | 2003-294483 | A | 10/2003 |
| JP | 2006-57530 | A | 3/2006 |
| JP | 2007-146717 | A | 6/2007 |
| JP | 2007-278225 | A | 10/2007 |

* cited by examiner

HANDHELD WORK APPARATUS HAVING AN AIR-COOLED COMBUSTION ENGINE

CROSS REFERENCE TO RELATED APPLICATION

This application claims priority of German patent application no. 10 2009 053 236.6, filed Nov. 6, 2009, the entire content of which is incorporated herein by reference.

FIELD OF THE INVENTION

The invention relates to a handheld work apparatus, especially a chain saw, a cutoff machine, a hedge trimmer, a brush cutter, a blower apparatus or the like.

BACKGROUND OF THE INVENTION

Portable handheld work apparatus of the type listed above are used, for example, as chain saws in many applications and include an oil-in-gasoline lubricated engine, usually a two-stroke engine, which is air-cooled via a cooling blower and is arranged in a housing.

The cooling blower is flanged directly on the crankshaft of the engine, so that the conveyed amount of air is proportional to the revolutions per minute of the combustion engine.

The cooling air flows into the cooling air blower via an air intake grid. The cooling air is guided through the housing via the cylinder which is outfitted with corresponding cooling ribs. If the air intake to the air grid of the air blower is obstructed or the air grid is partially blocked by leaves or the like, the movement of cooling air is reduced. This can lead to undesirable temperatures in the engine, for example on its cylinder, which can reduce the service life of the engine.

SUMMARY OF THE INVENTION

It is an object of the invention to ensure sufficient cooling of the air-cooled combustion engine of a handheld work apparatus even under unfavorable operating and environmental conditions.

The handheld work apparatus of the invention has a work tool and includes: a handle to guide the work apparatus; a casing; an air-cooled, mixture-lubricated combustion engine having operating parameters; the combustion engine being arranged in the casing configured to drive the work tool; the engine including a piston and a cylinder having a combustion chamber delimited by the piston; the combustion chamber being configured to be supplied with an air/fuel mixture; the engine further including a crankcase; a crankshaft mounted in the crankcase; the crankshaft being configured to be driven by the piston and being operatively connected to the work tool; an ignition control; a spark plug projecting into the combustion chamber and being controlled by the ignition control to trigger an ignition spark in dependence on the rpm and the angular position of the crankshaft to ignite the air/fuel mixture; a fuel metering device for supplying fuel; a throttle flap configured to have a position coordinated with the amount of fuel supplied by the fuel metering device; an intake channel having a flow cross section which can be set in dependence upon the position of the throttle flap; a cooling air blower for generating a cooling air flow to cool the cylinder; a temperature sensor configured to directly or indirectly measure the temperature of at least one component of the combustion engine and outputting a temperature signal in dependence upon the temperature; a power control; the temperature sensor being connected to the power control for transmitting the temperature signal thereto; and, the power control being configured to adjust the operating parameters of the combustion engine to vary the power of the combustion engine.

Advantageously, the temperature of a component of the engine is indirectly or directly detected by a temperature sensor and the output signal of the temperature sensor is supplied to a power control. The power control functions in such a manner that it changes the operating parameters of the engine when a predetermined temperature value is reached, so that the power output of the engine is changed, in particular is reduced, in order to lower the temperature of the engine.

Preferably, the component to be monitored is the cylinder of the engine. A temperature sensor is arranged directly on the cylinder in order to directly detect the temperature of the component.

Arranging the temperature sensor in the crankcase can be advantageous. The temperature sensor can be in the gas flow of the gas-mixture suction-intake in the crankcase, in order to detect the temperature of the gas, for example the mixture, in the crankcase. As a result of this gas temperature measurement, an indirect measurement of the temperature of the engine or a component thereof is possible.

It can also be practical to arrange the temperature sensor in the ignition module which is fixed on the engine block or directly on the cylinder. The temperature sensor in the ignition module shows an indirect temperature which is proportional to the direct temperature of the engine block or the cylinder. On the basis of the indirect temperature signal, the power control intervenes in the operating parameters of the combustion engine.

According to an embodiment of the invention, the temperature sensor is arranged on the electronic circuit board of the ignition control or the circuit board of the power control, so that external sensor lines are not required.

The alteration of the temperature, especially reduction of the temperature, is effected in a simple manner by enriching the air/fuel mixture. The enthalpy of the vaporizing additional fuel extracts heat from the cylinder of the engine, so that the temperature of the cylinder drops and thus also the temperature of the component of the engine. Even in the case of a disturbance or reduction of the cooling airstream, it is thereby guaranteed that predeterminable maximum temperature values are not exceeded.

Enriching of the air/fuel mixture can simply be achieved by increasing the amount of fuel supplied. A change in the amount of fuel supplied can also be achieved by changing the time-dependent supply of fuel in a suitable manner. Alternatively or simultaneously, it is also possible to reduce the amount of air supplied, which—with the same amount of fuel—also leads to enrichment of the air/fuel mixture.

As a further measure to regulate the temperature of a combustion engine, it can be advantageous when the power control limits the revolutions per minute of the engine, preferably in that the ignition time is changed, especially by suppressing the ignition for one or more rotations of the crankshaft or only by changing the ignition sequence, that is, by predetermining an impressed ignition sequence for the further ignitions. The suppression of the ignition can be regular, for example, every second or third crankshaft rotation, or it can also be irregular. The power control can fully shut off the engine. If the maximum temperature limits are exceeded despite the commencement of countermeasures, the power control is configured such that it fully shuts off the engine.

In a preferred embodiment, the suppression of the ignition is configured in such a manner that it is acoustically perceivable by the operator, whereby an acoustic indication, for example, of an excessive temperature of a component of the combustion engine is given.

The operator can be informed of critical temperature values via an optical and/or acoustical indication.

As a further safety feature, it can be provided that upon reaching a temperature value, the power control starts a timer and shuts down the engine when the received temperature signal is still in the area of or above the temperature value after expiry of the timing element.

In a further embodiment of the invention, for the purpose of reducing the temperature, it may be provided that the power control changes the rpm, in particular changes the idling rpm, and in particular increases it. Thereby, an increased cooling of the engine during idling is given. If the nominal speed and/or the maximum speed of the engine is changed by the power control, in particular if it is reduced, the possible heat input is reduced, so that the temperature of the engine does not increase or decrease any further.

The temperature of the engine can also be influenced if the power control intervenes at the ignition and changes, for example, the ignition timing or the ignition energy, advantageously the energy course of the ignition energy. This can advantageously also be achieved if the power control changes the control times of intake and/or output of the combustion engine or also changes the exhaust-gas back pressure of the exhaust gas muffler.

In particular, the power control can change the crankcase pressure, preferably the course of pressure of the crankcase or even the compression of the combustion engine, in order to influence the power output and thereby the temperature of the combustion engine.

In a further embodiment of the invention, the temperature of the supplied fuel is changed or the location of introducing the fuel is changed in order to influence the power output of the engine.

A direct effect on the temperature of the combustion engine can be achieved by changing the amount of supplied cooling air, especially by controlling an additional coolant supply.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
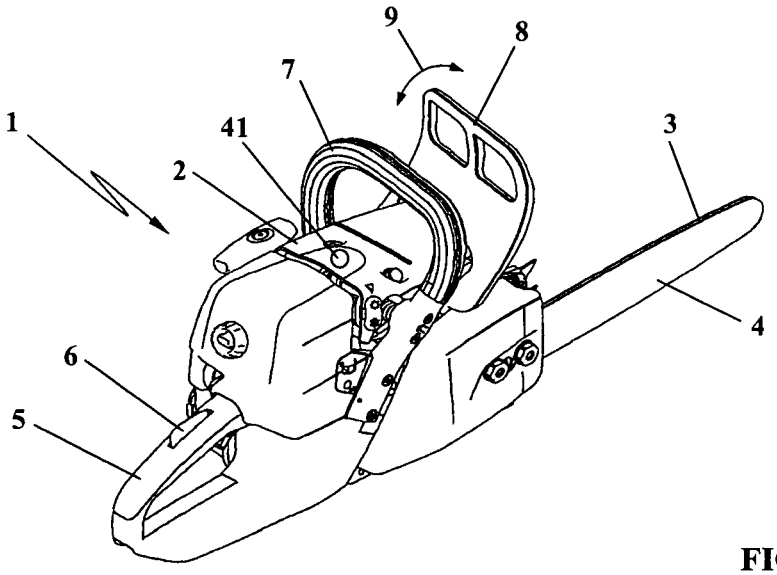
FIG. 1 is a perspective, schematic view of a chain saw as an example of a handheld work apparatus; and, FIG. 2 is a schematic view of a drive motor of the work apparatus from FIG. 1.

The invention generally relates to a handheld work apparatus 1, which as an example, is shown as a chain saw in FIG. 1. The handheld work apparatus 1 can also be a cutoff machine, a hedge trimmer, a brush cutter, a blower or similar work apparatus.

The portable handheld work apparatus 1, that is, a chain saw, essentially consists of a casing 2 in which an internal combustion engine 10 is provided as a drive for a work tool 3. In the chain saw, the work tool is a saw chain 3 which runs on a guide bar 4.

A rear handle 5 extending in the longitudinal direction of the work apparatus 1 and having operator-controlled elements 6 is provided on the casing 2 of the chain saw. A front handle 7 overlaps the casing 2 and lies at a distance thereto, so that the front handle 7, configured as a bale handle, can be gripped on its top section as well as its side section. A hand guard 8 is disposed in front of the front handle 7. The hand guard 8 is movable in the direction of arrow 9 and serves to trigger or release a safety braking device for the running saw chain 3.

The combustion engine 10 provided in the casing 2 of the work apparatus 1 is a mixture-lubricated engine, especially an air-cooled, mixture-lubricated engine. It is practical to provide a two-stroke engine, especially a one-cylinder two-stroke engine, as a drive for the work tool 3. The alternative use of an air-cooled, mixture-lubricated or separately lubricated four-stroke engine or a rotary piston engine can be advantageous.

Figure 2:
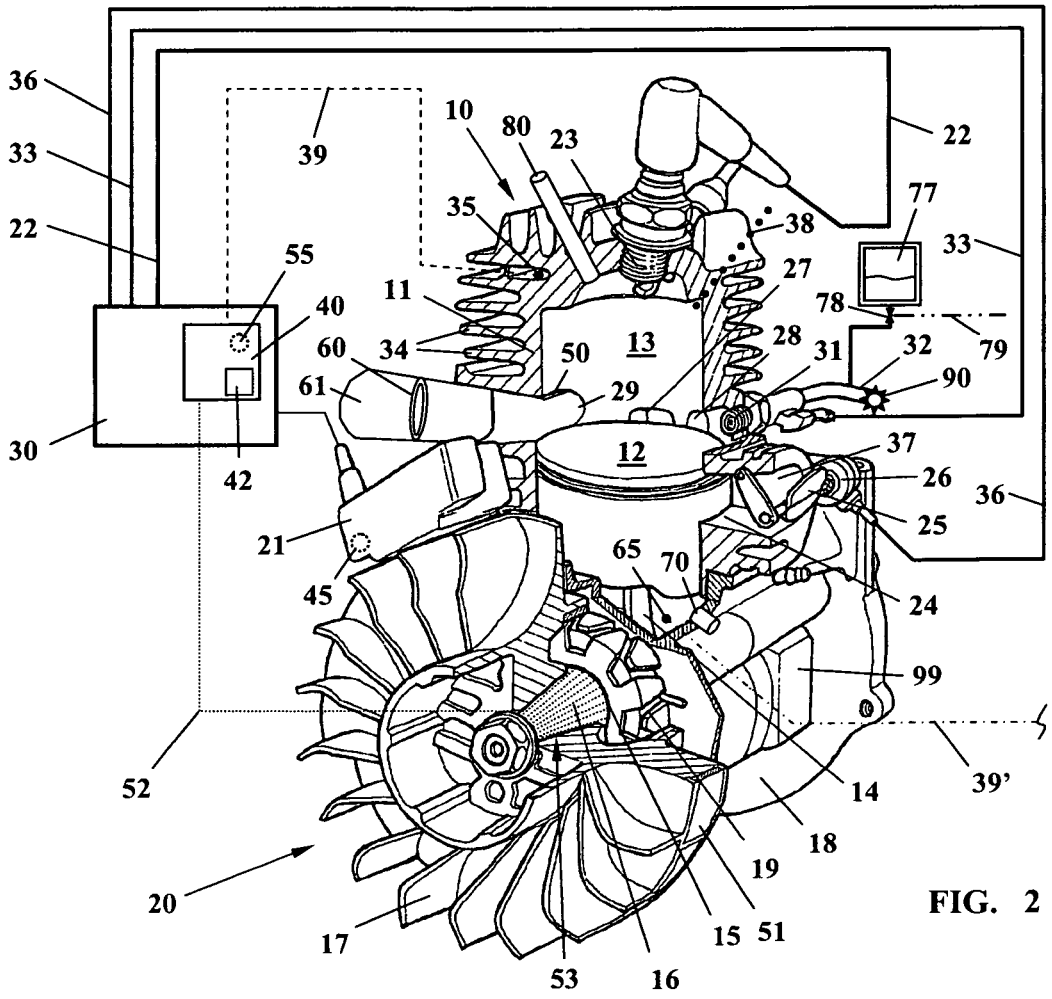

As FIG. 2 shows, the engine 10 comprises a cylinder 11 having a combustion chamber 13 which is delimited by a piston 12. The piston 12 drives a crankshaft 15 via a connecting rod 14. The crankshaft 15 drives the drive work tool 3 at one end via a centrifugal clutch (not shown).

At the other end 16 of the crankshaft, a fan wheel 17 of a cooling blower 20 is mounted, so that the fan wheel 17 revolves at the speed of the crankshaft 15. A generator 19 is arranged between fan wheel 17 of the cooling blower 20 and the crankcase 18. The generator 19 is used to operate electrically powered components of the engine 10, such as the carburetor heating, grip heating, servo-motors, electro-magnetic valves, and the like. The generator 19 can also provide the supply voltage for electronic units of the engine control as well for the ignition control.

In the shown embodiment, the fan wheel 17 of the cooling blower 20 is driven via an electromagnetic clutch 53, which is controlled by a power control 40 via a control line 52. The power control 40 can change the slip of the clutch between 0 (engaged) and 1 (disengaged), whereby the speed of the fan wheel 17 is variable and the cooling air flow can be set according to the requirements. Thus, on the one hand, quick heating of the combustion engine 10 to its operating temperature by means of a reduced cooling-air supply (large slip) and, on the other hand, an increased cooling air supply (small slip) to cool the engine 10 for example under full load can be achieved.

If the fan wheel 17 is connected rotatably fixed with the crankshaft 15, a magnetic pole 51 rotates with the fan wheel 17. The magnetic pole 51 generates the energy for an ignition spark in the yoke of an ignition module 21 and provides a position signal of the crankshaft 15, which signal is passed on to an ignition control 30. The ignition control 30 is connected to a spark plug 23 via a high-voltage line 22. The spark plug 23 is screwed into the cylinder 11 of the combustion engine 10 and projects into the combustion chamber 13 with its electrode. Depending on the revolutions per minute and the angular position of the crankshaft 15, an ignition spark is triggered at the spark plug 23 by the ignition control 30 in order to ignite an air/fuel mixture in the combustion chamber 13.

If the fan wheel 17 is connected to the crankshaft 15 via a clutch 53, the magnetic pole 51 is fixedly assigned to the crankshaft 15; thereby the magnetic pole 51 rotates angle-precise with the crankshaft 15, independently of the revolutions per minute and the rotational position of the fan wheel 17.

An intake channel 37, whose inlet 24 in the embodiment is controlled by a piston skirt of the piston 12, opens into crankcase 18 of the mixture-lubricated combustion engine. A membrane inlet or a valve-controlled inlet can also be provided. A throttle valve 25 is arranged in the intake channel 37 as a control unit, by means of which the flow cross-section of the intake channel 37 can be set. Thereby, the position of the throttle valve 25 can be set by an actuator such as an advantageous electromagnetic servo component 26, which for example can be a stepping motor or the like.

In the shown embodiment of a combustion engine, the combustion air, which is conveyed to the crankcase 18 via the intake channel 37, is conveyed to the combustion chamber 13 via overflow channels 27 and 28. The crankcase 18 is thus connected to the combustion chamber 13 via overflow channels 27 and 28. The openings of the overflow channels 27 and 28 into the combustion chamber 13 are controlled by piston 12.

An outlet 29, via which exhaust gases are discharged from the combustion chamber, is also controlled by the piston 12.

In the embodiment, an adjusting device 50, with which the upper control edge of the outlet 29 can be changed, is provided above the outlet 29. Thereby, the timing of when the outlet 29 is opened after a combustion can be changed.

In the shown embodiment, the amount of fuel required to operate the combustion engine 10 is supplied through an electromagnetic fuel valve 31, which is connected via a fuel line 32 to a fuel system which is under admission pressure. The fuel valve 31 is operated by the ignition control 30 via a control connection 33, whereby an amount of fuel corresponding to the load state and the revolutions per minute of the combustion engine 10 is supplied. This can happen via a digital valve which forms the fuel valve 31 and which is driven in a pulsewidth modulated manner. The fuel valve 31 conveys fuel into the overflow channel 28 which is remote from the outlet; it can be practical to choose the intake channel 37 as the location for introducing fuel.

Alternatively or additionally to the fuel valve 31, a different location for fuel injection is provided in the embodiment. Thus, an injection valve 38, shown as a dotted line, can be provided on the cylinder 11, which valve directly conveys fuel into the combustion chamber 13. The injection valve 80 is also controlled by the ignition control 30 and/or by the power control 40 in order to choose the location where fuel is supplied based on the measured temperature of a component of the combustion engine 10.

As FIG. 2 shows, a heating device 90 for fuel can be provided at the conveying fuel line 32 in order to bring the fuel to an advantageous temperature. Such a heating device can also be integrated in the fuel valve 31 or—in carburetors—be installed at the outlet nozzle. The power control 40 controls the heating device 90 in accordance with the desired influencing of the engine output, that is, the operating temperature of the combustion engine 10.

During operation of the combustion engine 10, an amount of combustion air drawn into the crankcase 18 is conveyed into the combustion chamber 13 via the overflow channels 27 and 28 when the piston is moving downward. Simultaneously, fuel is metered into the overflow channel 28 via the fuel valve 31. During an up-stroke of the piston 12, the air/fuel mixture in the combustion chamber 13 is compressed and is—controlled by the ignition control 30—ignited at a predetermined position of the crankshaft. During an up-stroke of the piston 12 new fresh air is drawn into the crankcase 18 via the intake channel 37. After the ignition of the mixture in the combustion chamber 13, the piston moves downward, rotates the crankshaft 15 and thereby opens the outlet 29 to remove the exhaust gases via an exhaust gas muffler 61.

The metered addition of fuel via the fuel valve 31 is provided in such a manner that mixture from the overflow channel 28 gets into the crankcase 18 so that a complete oil-in-gasoline lubrication is ensured.

The cylinder 11 is an air-cooled cylinder, which has corresponding cooling fins 34 on its outer periphery. The air flow generated by the fan wheel 17 of the cooling air blower 20 is guided through the housing 2 via the cylinder 11 and exits the housing 2 at an appropriate location. The output of cooling air is dependent on the variable revolutions per minute of the fan wheel 17, that is, on the slip of the electromagnetic clutch 53 and the revolutions per minute of the driving crankshaft 15.

To monitor the cylinder temperature, a temperature sensor 35 can be provided in the cylinder 11. The output signal of the temperature sensor 35 is delivered to a power control 40 via a signal line 39. The temperature of the cylinder 11 is monitored in the power control 40. If the temperature signal reaches or exceeds a predetermined temperature value, if, for example, the temperature of the cylinder 11 is too high, then the power control 40 intervenes, for example, in the ignition control 30, and changes the operating parameters of the combustion engine 10 in such a manner that its power output is changed, especially reduced. As a result thereof, the temperature in the cylinder 11 drops. A change in power output of the combustion engine 10 can be easily accomplished by enriching the air/fuel mixture. In a first embodiment, this can occur in that the fuel valve 31 is opened longer via the control line 33, in order to supply more fuel, while the amount of air supplied remains unchanged. The mixture enriches, whereby the power output of the combustion engine 10 drops. The larger amount of evaporating fuel draws heat from the cylinder 11 and—partially combusted—is discharged via an exhaust gas outlet 29.

To change the power output of the combustion engine 10 to reduce the operating temperature, it can also be sufficient to change the temporal course of supplying fuel, that is, change the fuel flow. For this purpose, the power control 40 correspondingly intervenes in the driving of the electromagnetic fuel valve 31.

Alternatively, it may also be provided to change the position of the throttle flap 25 via the control line 36 and the actuator 26, for example, to change the throttle flap 25 to narrow the flow cross-section of the intake channel 37. Thereby, less combustion air enters the crankcase and the combustion chamber 13 via the overflow channels 27 and 28, so that—supposing an unchanged amount of fuel—the mixture also enriches. The power output of the combustion engine drops and the temperature sinks.

It can be practical to supply an increased amount of fuel as well as decrease the flow cross-section of the intake channel 37 in order to reduce the amount of combustion air supplied while the amount of fuel supplied is increased.

In a further embodiment, it can be provided that the ignition control 30 suppresses one or more ignitions. This means, for example, that when reaching a first temperature value the power control 40 intervenes in the ignition control 30 in such a manner that, for example, an ignition spark is generated only every second rotation of the crankshaft 15. No ignition spark is generated every second rotation, which can directly lead to a reduction of the cylinder temperature. It can also be practical to suppress the ignition every third or fourth crankshaft rotation or to suppress the ignition for consecutive rotations of the crankshaft. In particular, an irregular sequence of suppressed ignitions or a predetermined ignition sequence is advantageous.

In a further embodiment, the suppression of the ignition can be provided in that the spark failures are so configured that they are clearly observable to the operator. In this manner, an acoustic indication is possible whenever a predetermined temperature value is exceeded.

In order to lower the power of the combustion engine, it can also be practical to adjust the ignition angle and/or the ignition timing, for example to "retard", via the ignition control 30. Thus, a reduction in the power of the engine 10 and thereby a reduction in the cylinder temperature is possible.

Thereby, a dynamic influencing of the nominal speed in dependence on the measured temperature can be achieved via the power control 40. If the measured operating temperature is above a predetermined temperature value, the attainable nominal speed of the combustion engine 10 is reduced.

In the same fashion, a temperature reduction can be provided in that the power control changes the idling speed, especially increases the idling speed. Thereby, an increased cooling of the combustion engine is possible while idling.

The maximum speed of the combustion engine can also be changed by the power control, in particular reduced, whereby the possible thermal input is decreased. The temperature of the combustion engine will not further increase or will even decrease.

In regards to the ignition control, it is also possible to intervene in the ignition control 30 via the power control in such a manner that a reduced ignition energy for an ignition spark is provided. A weaker ignition spark leads to a changed flame front formation and thereby to a changed thermal input into the cylinder 11. To influence the flame formation, the energy distribution over time can be changed.

In an advantageous embodiment, an optical display 41, which can for example be an LED, is provided on the housing 2 of the work tool 1. The optical display 41 is expediently driven directly by the power control 40, whereby—when a multi-colored LED is used—the degree to which the temperature is exceeded can be displayed to the operator.

Thus, for example, it is possible to drive an LED, which lights up green during normal operation, in such a manner that when a first temperature threshold value is exceeded, the color of the LED is changed to yellow via an altered drive, and then when a next, second threshold value is exceeded, the color of the LED is switched to red. When a third threshold value is exceeded the LED can be triggered to be flashing in red.

To avoid an external temperature sensor 35, it can be expedient to provide a temperature sensor 45 in the ignition module 21 which is fixed on the engine block of the combustion engine 10. Since the ignition module 21 is directly connected to the combustion engine 10 and/or occupies the same space, a temperature sensor 45 arranged in the ignition module 21 indirectly reports—possibly delayed—a temperature which is proportional to the temperature of the cylinder. Through an appropriate selection of temperature values, an operation of the performance control in dependence on the output signal of the temperature sensor 45 is possible as described.

In a preferred embodiment, a temperature sensor 55 is provided directly on the circuit board of the ignition control 30 or the power control 40. In this case, no signal lines are required. Since the ignition control 30 and the power control 40 are also arranged in the casing 2 of the combustion engine 10, a temperature sensor 55 arranged on the circuit board of the electronics can give a signal—potentially delayed—which is proportional to the cylinder temperature. Through corresponding adaptation of the temperature values it is also possible to have a power control for the purpose of reducing the temperature of the cylinder 11 with the sensor 55 being arranged on the electronic circuit board.

It can also be expedient to provide a temperature sensor 65 in the crankcase 18 in such a manner that the sensor 65 measures the temperature of the volume of gas flowing through the crankcase 18. Detecting the gas temperature is an indirect measurement of the operating temperature of the engine 10, since a direct heat transfer takes place from the components of the engine 10 and onto the volume of gas confined in the crankcase 18. The sensor 65 can be connected to the power control 40 via a signal line 39'.

In a further embodiment it is provided that the power control 40 includes a time function element 42, which is started when a temperature threshold value is exceeded. If the temperature remains above the temperature threshold value, after a predetermined amount of time has passed, the engine 10 is shut down by the power control 40 in order to avoid temperature damage.

The power control 40 is advantageously arranged in the casing of the ignition control 30, which simplifies a direct intervention in the ignition control 30. Expediently, the ignition control 30, the power control 40, and the temperature sensor 55 are arranged on a joint circuit board.

Aside from the possibility of intervening at the ignition, other alternative or additional measures are suited to change the performance of the combustion engine 10 in order to for example actively influence the operating temperature of the combustion engine. By means of a corresponding intervention the temperature can be reduced or—as needed—be increased. If, for example, the power control 40 intervenes in such a manner that the control times of the inlet 24 and/or the outlet 29 of the combustion engine 10 are changed, this will have direct effects on the power and thus the temperature of the engine 10. For the intervention, for example, at the outlet 29, the adjusting device 50 is triggered, whereby the upper adjusting edge of the outlet 29 is shifted and thus the control time is changed.

By intervening at the exhaust gas muffler 61, which connects to the outlet 29, the power can also be influenced. If, for example, an adjustable throttle 60 is inserted in the flow path of the exhaust gas muffler 61, the exhaust gas back pressure can be varied. The power control 40 controls the throttle 60 in the exhaust muffler 61 of the combustion engine 10 in dependence on the measured temperature values.

A power control can also be achieved by influencing the crankcase pressure. For this purpose, a valve 70, which can be electromagnetically driven by the power control 40, is provided, via which pressure can be discharged or additionally built up. By changing the course of pressure in the crankcase 18 the filling of the combustion chamber 13 is influenced, which directly effects the power output of the combustion engine 10 and the operating temperature thereof.

In a similar manner, the power control 40 can also change the compression. For this, a pressure valve 80 is provided on the cylinder 11, via which the combustion chamber 13 is to be connected to the surroundings or the atmosphere. The power control drives the pressure valve according to the desired intervention in the power.

In a further embodiment of the invention, it can also be expedient to supply an additional lubricant via the power control 40. In the shown embodiment there is provided a lubricant tank 77 which is connected to the fuel system; in the shown embodiment the tank 77 is connected to the fuel line 32 via a flow valve 78. The flow valve 78 is connected via a control line 79 to the power control 40, which adds lubricant in dependence on the detected temperature values and thus changes the power of the combustion engine 10.

It can be practical to provide a heat accumulator 99, which is in heat-transfer-connection to the combustion engine 10. In the embodiment, the heat accumulator 99 is connected to the crankcase 18. The heat transfer between the heat accumulator 99 and the combustion engine 10 can be controlled via the power control 40, so that heat is supplied to the combustion engine 10 in phases of low operating temperature, and heat is discharged from the combustion engine 10 in phases of high operating temperature.

In further embodiments, upon reaching a predetermined temperature, the temperature of the combustion air supplied to the combustion engine can be changed in such a manner that the performance of the combustion engine is influenced, in particular is reduced, which results in a decrease in the temperature of the combustion engine. Aside from the change in temperature of the supplied combustion air or intake air, as another parameter, the pressure of the supplied combustion air or intake air can be influenced with the result that the temperature of the combustion engine is reduced.

The described measures to change the power of a combustion engine can be used separately or in combination. A combination of different measures can be advantageous, especially for a quick intervention with an immediate effect on the operating temperature.

It is understood that the foregoing description is that of the preferred embodiments of the invention and that various changes and modifications may be made thereto without departing from the spirit and scope of the invention as defined in the appended claims.

What is claimed is:

1. A hand-held work apparatus having a work tool, the work apparatus comprising:

a handle to guide said work apparatus;

a casing;

an air cooled, single cylinder two-stroke combustion engine having operating parameters;

said combustion engine being arranged in said casing and being configured to drive said work tool;

said engine including a piston and an air-cooled cylinder having a combustion chamber delimited by said piston;

said combustion engine being a mixture lubricated engine and including a cooling blower for generating a cooling air flow for cooling said air-cooled cylinder of said combustion engine;

said crankcase being configured to permit fuel to be supplied thereto so as to ensure a complete mixture lubrication;

said combustion chamber being configured to be supplied with an air/fuel mixture;

said engine further including a crankcase;

a crankshaft mounted in said crankcase;

said crankshaft being configured to be driven by said piston and to drive said work tool with a driving power developed by said engine;

an ignition control;

a spark plug projecting into said combustion chamber and being controlled by said ignition control to trigger an ignition spark in dependence on the rpm and the angular position of said crankshaft to ignite said air/fuel mixture;

a fuel metering device for supplying fuel;

a throttle flap configured to have a position coordinated with the amount of fuel supplied by said fuel metering device;

an intake channel having a flow cross section which can be set in dependence upon the position of said throttle flap;

a temperature sensor configured to directly or indirectly measure an operating temperature of said combustion engine and outputting a temperature signal of said combustion engine in dependence upon said operating temperature;

a power control of said combustion engine;

said temperature sensor being connected to said power control for transmitting said temperature signal of said combustion engine thereto; and, said power control being configured to adjust said operating parameters of said combustion engine when said operating temperature reaches a pregiven temperature limit value of said combustion engine to effect a reduction of said driving power of said engine in order to reduce heat input and therewith to change the temperature of said combustion engine and to so actively control said operating temperature of said combustion engine.

2. The work apparatus of claim 1, wherein said temperature sensor is arranged on said cylinder.

3. The work apparatus of claim 1, wherein said temperature sensor is arranged in said crankcase.

4. The work apparatus of claim 3, wherein said crankcase has a gas flow; and, said temperature sensor is arranged in said gas flow.

5. The work apparatus of claim 1, wherein said intake channel has a gas flow; and, said temperature sensor is arranged in said gas flow.

6. The work apparatus of claim 1, wherein said power control changes said air/fuel mixture.

7. The work apparatus of claim 6, wherein said power control enriches the air/fuel mixture.

8. The work apparatus of claim 1, wherein said power control is configured to suppress said ignition spark for at least one revolution of said crankshaft.

9. The work apparatus of claim 1, wherein said ignition spark has a firing order; and, said power control changes said firing order.

10. The work apparatus of claim 1, wherein said power control changes the timing of said ignition spark.

11. The work apparatus of claim 1, wherein said power control has at least one of an optical display and an auditory indicator.

12. The work apparatus of claim 1, further comprising:

a timing element controlled by said power control; and, said timing element influencing said combustion engine after a predetermined amount of time after a temperature value is reached.

13. The work apparatus of claim 12, wherein said timing element is configured to shut down said combustion engine after a predetermined amount of time after a temperature value is reached.

14. The work apparatus of claim 1, wherein said combustion engine has an idling speed, a nominal speed, and a maximum speed; and, said power control changes at least one of said idling speed, said nominal speed, and said maximum speed.

15. The work apparatus of claim 1, wherein said ignition spark has an igniting energy having an energy distribution over time; and, said power control changes one of said igniting energy and said energy distribution over time.

16. The work apparatus of claim 1, wherein said combustion engine has an outlet having control times and an intake having control times; and, said power control changes control times for at least one of said intake and said outlet.

17. The work apparatus of claim 1, wherein said combustion engine has an exhaust muffler having an exhaust gas back pressure; and, said power control changes said exhaust gas back pressure.

18. The work apparatus of claim 1, wherein said crankcase has a crankcase pressure having a pressure distribution over time; and, said power control changes at least one of said crankcase pressure and said pressure distribution over time of said crankcase pressure.

19. The work apparatus of claim 1, wherein said combustion engine has a seal; and, said power control adjusts said seal.

20. The work apparatus of claim 1, wherein said power control changes the temperature of said amount of fuel supplied.

21. The work apparatus of claim 1, wherein said combustion engine is supplied with combustion air; and, said power control changes the temperature of said combustion air.

22. The work apparatus of claim 1, wherein said power control changes the location at which fuel is supplied.

23. The work apparatus of claim 1, wherein said power control is configured to change the amount of cooling air.

24. The work apparatus of claim 23, wherein said power control is configured to control an additional amount of said cooling air.

25. The work apparatus of claim 1, wherein said power control is configured to supply lubricant to said engine.

26. The work apparatus of claim 1, wherein said operating temperature of said combustion engine does increase further beyond said temperature limit value.

27. The work apparatus of claim 1, wherein said operating temperature of said combustion engine is reduced.

28. A hand-held work apparatus having a work tool, the work apparatus comprising:

a handle to guide said work apparatus;

a casing;

an air cooled, single cylinder two-stroke combustion engine having operating parameters;

said combustion engine being arranged in said casing and being configured to drive said work tool;

said engine including a piston and an air-cooled cylinder having a combustion chamber delimited by said piston;

said combustion engine being a mixture-lubricated engine and including a cooling blower for generating a cooling air flow for cooling said air-cooled cylinder of said combustion engine;

said combustion chamber being configured to be supplied with an air/fuel mixture;

said engine further including a crankcase;

a crankshaft mounted in said crankcase;

said crankshaft being configured to be driven by said piston and to drive said work tool with a driving power developed by said engine;

said crankcase being configured to permit fuel to be supplied thereto so as to ensure a complete mixture lubrication;

an ignition control;

a spark plug projecting into said combustion chamber and being controlled by said ignition control to trigger an ignition spark in dependence on the rpm and the angular position of said crankshaft to ignite said air/fuel mixture;

a fuel metering device for supplying fuel;

a throttle flap configured to have a position coordinated with the amount of fuel supplied by said fuel metering device;

an intake channel having a flow cross section which can be set in dependence upon the position of said throttle flap;

a cooling air blower for generating a cooling air flow to cool said air-cooled cylinder of said combustion engine;

a temperature sensor configured to directly or indirectly measure an operating temperature of said combustion engine and output a temperature signal of said combustion engine in dependence upon said operating temperature;

a power control of said combustion engine;

said temperature sensor being connected to said power control for transmitting said temperature signal of said combustion engine thereto; and, said power control of said combustion engine being configured to change said operating parameters upon reaching a predetermined temperature limit value of said combustion engine to reduce the power of said combustion engine in order to reduce the heat input into said combustion engine and to therewith change the temperature of the combustion engine in order to actively control said operating temperature of said combustion engine with said power of said combustion engine being reduced so as to permit the reduction in power to be acoustically perceived by an operator whereby an acoustic indication of reaching said predetermined temperature limit value is given.

29. A method for operating a hand-held work apparatus having a work tool, the work apparatus including:

a handle to guide said work apparatus;

a casing;

an air cooled, mixture lubricated, single cylinder two-stroke combustion engine having operating parameters;

said combustion engine being arranged in said casing and being configured to drive said work tool;

said engine including a piston and an air-cooled cylinder having a combustion chamber delimited by said piston;

said engine further including a crankcase;

a crankshaft mounted in said crankcase;

said crankshaft being configured to be driven by said piston and to drive said work tool with a driving power developed by said engine;

a throttle flap;

an intake channel having a flow cross section which can be set in dependence upon the position of said throttle flap;

a cooling blower for generating a cooling air flow to cool said air-cooled cylinder of said combustion engine; and, a temperature sensor configured to directly or indirectly measure a temperature of at least one component of said combustion engine and output a temperature signal of said combustion engine;

the method comprising the steps of:

supplying an air/fuel mixture to said combustion chamber which is ignited by a spark plug projecting into said combustion chamber controlled by an ignition control in order to trigger an ignition spark in dependence upon the rpm and angular position of said crankshaft;

coordinating the position of said throttle flap with the fuel quantity supplied from a fuel metering device;

supplying said temperature signal of said combustion engine to a power control of said combustion engine;

configuring said power control to do at least one of the following substeps when a pregiven temperature limit value of said combustion engine is reached:

(a) increase the fuel quantity supplied to said combustion engine; and, (b) reduce the air quantity supplied to said combustion engine;

supplying a mixture into said crankcase of said combustion engine during operation thereof; and, reducing the instantaneous power of said combustion engine by carrying out at least one of said substeps (a) and (b) in order to reduce heat input into said combustion engine and to so change the temperature of said combustion engine to actively control the operating temperature of said combustion engine.

30. The method of claim 29, wherein said power control changes a chronological course of said fuel supplied.

* * * * *